US009032887B2

(12) United States Patent
Viltrakis et al.

(10) Patent No.: US 9,032,887 B2
(45) Date of Patent: May 19, 2015

(54) CLAMP FOR EMBROIDERING THICK FABRICS

(76) Inventors: Vytenis J. Viltrakis, Fort Thomas, KY (US); Mark Mason, Fairfield, OH (US)

( * ) Notice: Subject to any disclaimer, the term of this patent is extended or adjusted under 35 U.S.C. 154(b) by 922 days.

(21) Appl. No.: 13/229,328

(22) Filed: Sep. 9, 2011

(65) Prior Publication Data

US 2012/0060732 A1 Mar. 15, 2012

Related U.S. Application Data

(60) Provisional application No. 61/381,269, filed on Sep. 9, 2010.

(51) Int. Cl.
*D05C 7/04* (2006.01)
*D05C 9/04* (2006.01)

(52) U.S. Cl.
CPC ..... *D05C 9/04* (2013.01); *D05D 2209/16* (2013.01)

(58) Field of Classification Search
USPC ..... 112/102, 103, 114, 260, 311, 470.09, 112/470.14, 470.18; 38/102.2–102.8
See application file for complete search history.

(56) References Cited

U.S. PATENT DOCUMENTS

| | | | | |
|---|---|---|---|---|
| 3,405,670 | A * | 10/1968 | Scholl et al. | 112/470.09 |
| 6,336,416 | B1 * | 1/2002 | French et al. | 112/103 |
| 6,679,190 | B1 * | 1/2004 | French et al. | 112/103 |
| 7,290,492 | B2 * | 11/2007 | Watanabe et al. | 112/103 |
| 7,584,708 | B1 * | 9/2009 | Viltrakis et al. | 112/103 |
| 2007/0079741 | A1 * | 4/2007 | Watanabe et al. | 112/103 |

* cited by examiner

*Primary Examiner* — Nathan Durham
(74) *Attorney, Agent, or Firm* — Porter Wright Morris & Arthur LLP

(57) ABSTRACT

A embroidery clamp for thick fabric includes a movable clamping window support that is pivotally connected to a frame and extends around a pivotal axis. An actuating system applies a force to the end of the clamping window support and rotates the support around to pivotal axis to move clamping windows together. The clamping window supports have resilient properties and are configured for flexure.

13 Claims, 5 Drawing Sheets

CLAMP FOR EMBROIDERING THICK FABRICS

RELATED APPLICATIONS

This application claims priority to Provisional Patent Application Ser. No. 61/381,269, filed Sep. 9, 2010.

TECHNICAL FIELD

The present invention relates generally to embroidery machines and more specifically to a clamp for securing an article as it is being embroidered. The invention will be disclosed in connection with a clamp that secures a relatively thick fabric, such as an athletic jacket, and securely allows embroidering of the fabric without slippage.

BACKGROUND OF THE INVENTION

In the sewing and embroidery industry, fabric holding clamps are widely used for holding individual work pieces during the embroidery process. While such holding clamps are been used for many years, problems have persisted in securely holding relatively thick items, such as athletic jackets, during the embroidery process. In particular, contemporary embroidery clamps have been unable to consistently hold the fabric in a stretched taut condition during the embroidery process. As a result, it has been exceedingly difficult to sew through thick fabrics with accuracy.

BRIEF SUMMARY

One example of the invention is a fabric clamp for an embroidery machine that includes a frame, at least one movable window support that is pivotally connected to the frame about a first pivotal axis and that has a configuration partially extending around the first pivotal axis. A first portion of the window support extends away from the first pivotal axis in a first direction and a second portion extending away from the first pivotal axis in a second direction that is angularly oriented relative to the first direction. The movable window support has a inner surface located proximally to the pivotal axis and an outer surface opposite the inner surface. A first clamping window is fixedly secured relative to the frame and a second clamping window is interconnected to, and movable with, the first end portion of the window support. An actuating system for applying a force against a second portion of the movable window support proximal to the second end is operative to rotate the first portion of the window support about the first pivotal axis and to move the second clamping window toward the first clamping window.

In one specific form of the invention, the actuating system includes a roller that rolls along the inner surface of the second portion of the movable window support about a movable rotatable axis that extends substantially parallel to the first pivotal axis.

In another specific example, the actuating system includes at least one lever for moving the roller along the inner surface of the second portion of the movable window support in response to an input force.

In one specific form of the invention, the lever is rotatable around the first pivotal axis.

Another example of the invention includes a force transfer member and the roller that rolls along the inner surface of the second portion of the window support is rotatably supported at a first end of the force transfer member.

In another example of the invention, an opposite end of the force transfer member is rotatably supported about an axis that is fixed relative to the frame.

According to another example, the actuating system includes a lever for providing a mechanical advantage to the force applied to the second portion of the window support.

In another example, the window support has an inner surface located proximally to pivotal axis and an outer surface opposite the inner surface, and the force applied to the second portion of the window support is a compressive force applied against the inner surface.

In another specific embodiment a spring is provided for resiliently urging the second portion of the movable window support to a first open position.

In another specific example, the spring includes a plurality of extension springs.

According to another example, the actuating system further includes at least one force transfer roller rotatably mounted about a pivotal axis that is movable relative to the frame. The force transfer roller is rollably movable along the second portion of the movable window support and the pivotal axis for the force transfer roller is rotatably movable about the first pivotal axis.

In another example, the second clamping window has a channel configuration with a base separating a pair of sidewalls projecting outwardly from the base in spaced parallel relationship in a direction toward the first clamping window.

In a still further example, the first clamping window has a channel configuration with a base and a pair of sidewalls projecting outwardly from the base in spaced parallel relationship in a direction toward the second clamping window. The first clamping window is sized relative to the second clamping window so that the channels overlap and one of the sidewalls is interposed between the sidewalls of the other clamping window when the first and second clamping windows are move together.

In another form of the invention, the first and second clamping windows each include a centrally disposed opening for accommodating a fabric to be embroidered.

In one specific embodiment each of the first and second clamping windows has a quadrilateral configuration with four right angles.

In one exemplary form, the movable clamping window is supported by a plurality of movable window supports.

In another example, each of the movable window supports has an elongated configuration with a dimension in the direction of movement that is thin relative to its other dimensions.

In a still further example, the movable window supports are resiliently flexible in the direction of movement.

BRIEF DESCRIPTION OF THE DRAWINGS

While the specification concludes with claims which particularly point out and distinctly claim the invention, it is believed the present invention will be better understood from the following description taken in conjunction with the accompanying drawings, in which like reference numbers identify the same elements in which:

Reference will be made in detail to certain exemplary embodiments of the invention, examples of which are illustrated in the accompanying drawings.

DETAILED DESCRIPTION OF THE EXEMPLARY EMBODIMENTS

Figure 1:
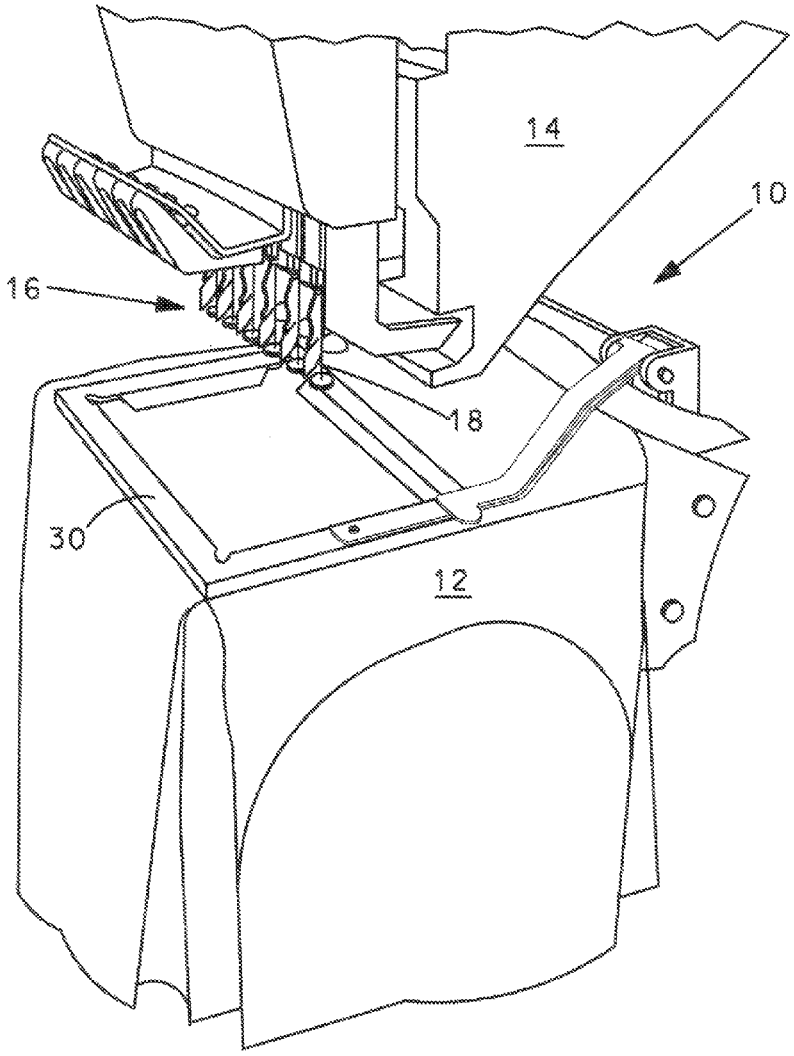
FIG. 1 is a perspective view showing an embroidery machine and clamp constructed according to the principles of the present invention.

Referring now to the drawings, FIG. 1 shows one form of an embroidery machine 10 constructed in accordance with the principles of the present invention. The machine, which is conventional except for the thick fabric clamp, which is described in detail below, includes a base 12, which supports a head 14 extending outwardly therefrom. A plurality of presser feet, collectively referenced by the numeral 16, extend downwardly from the head 14. As those skilled in the art will readily appreciate, the presser feet are movable from a first retracted position (shown in FIG. 1) to an extended position where they engage an article to be embroidered. Each of the presser feet 16 is associated with a needle 18. The outer end of each of the needles 18 pass though a fabric or other article (not shown in FIG. 1) interposed between the presser foot 16 and a throat plate secured to the base 12. As will be apparent to those skilled in the art, the lower (in the illustrated orientation) end of the needles interact with a bobbin or other type of hooking mechanism (not shown) positioned beneath the article being embroidered. As also will readily be appreciated by those in the art, the bobbin or other mechanism (not shown) grabs a loop of the thread carried by the needles and wraps it around either another piece of thread or another loop in the same piece of thread, as is conventional in sewing machines.

Figure 2:
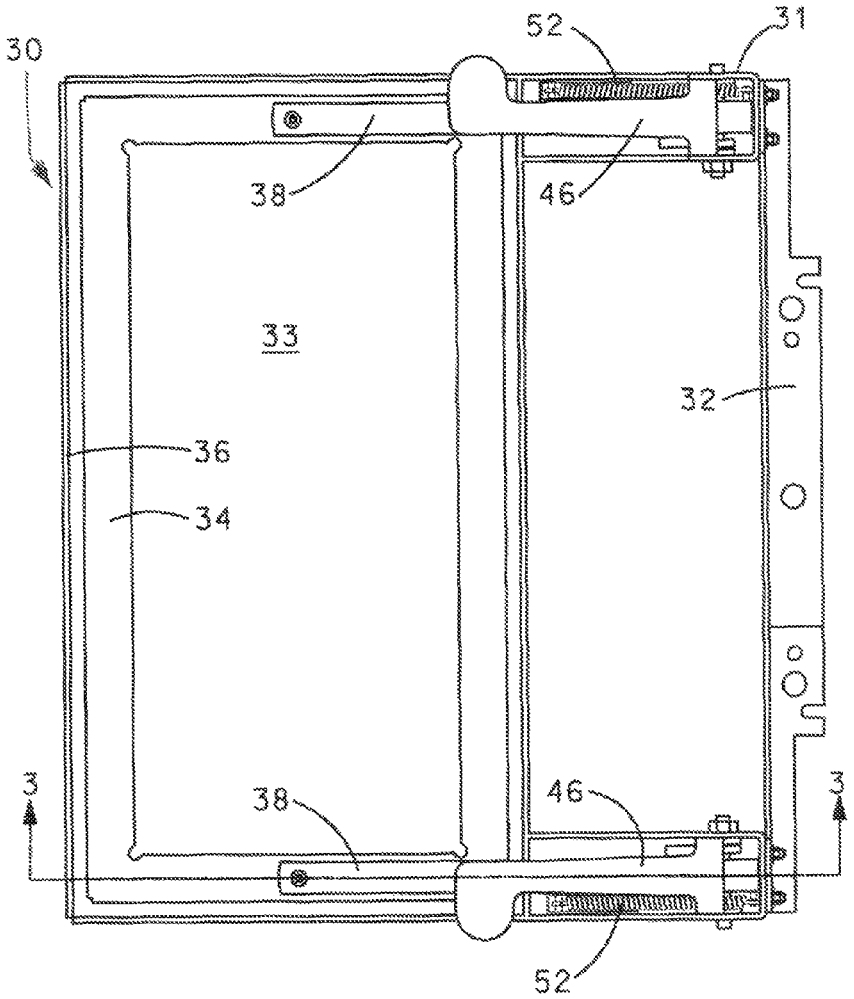
FIG. 2 is a plan view of the embroidery clamp shown in FIG. 1.

FIG. 2 is a plan view illustrating the clamp 30 shown in FIG. 1. The clamp 30 includes a frame 31 which is connected to the embroidery machine 10 through a bracket 32 on its rear portion. The clamp 30 includes upper and lower clamping windows 34, 36 respectively, which are movable between closed and open positions, shown in FIGS. 3 and 4 respectively. In the specific form illustrated, the lower clamping window 36 is integrally formed with the frame 31. As illustrated, each of the clamping windows 34 and 36 has a quadrilateral configuration with four right angles with a central opening 33, over which the fabric to be embroidered is stretched. The central opening in each of the clamping windows 34 and 36 are aligned with each other so that they can be compressingly urged against each other to secure an interposed article to be embroidered. As specifically illustrated, the quadrilateral is a rectangular, but those skilled in the art that, depending on the specific article to be embroidered, the size and shape of the clamping windows may be varied. For example, it may, for certain specific applications, be desirable to use circular, oval or other configurations for the window openings.

As perhaps best appreciated by jointly viewing FIGS. 1-4, the upper clamping window is interconnected to and supported by a plurality of window supports 38. As shown, the window supports 38 are operative to move the upper clamping window 34 from the open position shown in FIG. 4 to the closed position shown in FIG. 3. The specifically illustrated window supports 38 are generally flat and interconnect with the upper clamping window 34 about the window's (34) sides. The window supports 38 depicted in the drawings each have an elongated configuration with a dimension in the direction of movement (from the position of FIG. 4 to the position of FIG. 3) that is thin relative to its other dimensions. The window supports 38 also may be formed of a resilient material, such as spring tempered stainless steel. When formed of resilient material and configured with a relatively thin dimension in their direction of movement, the window supports 38 function as spring members.

Figure 4:
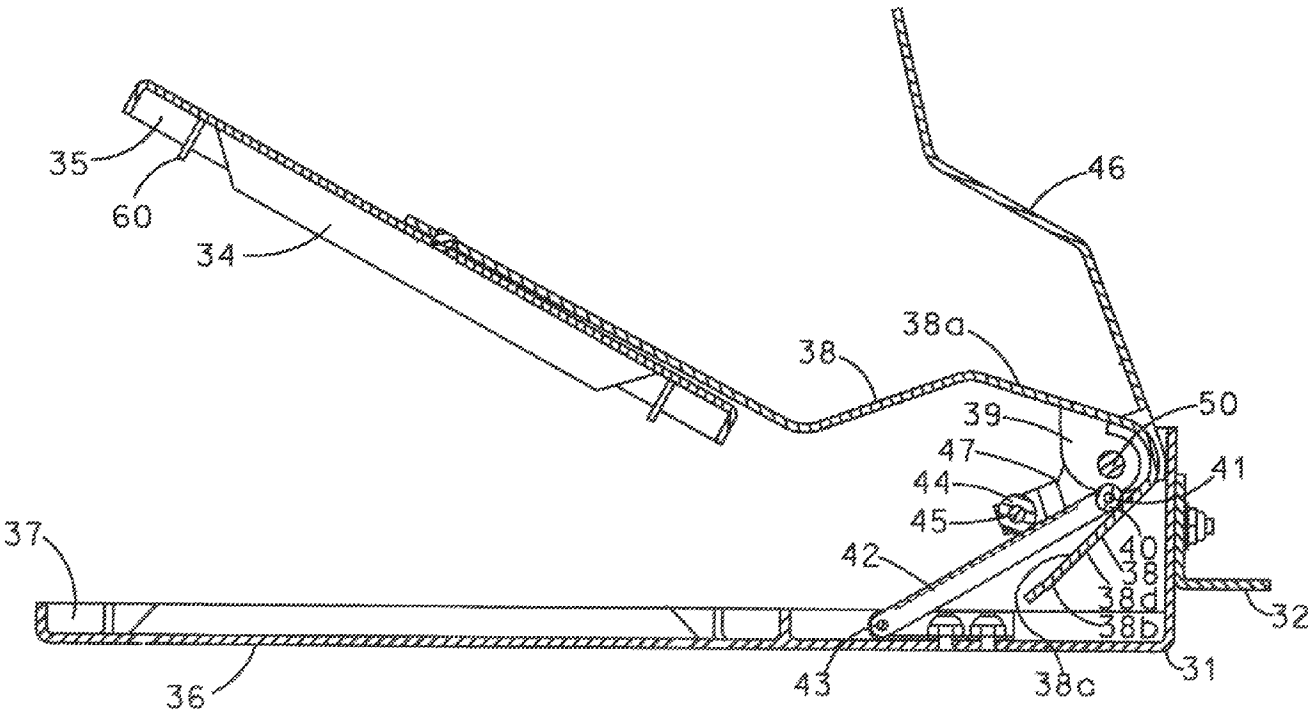
FIG. 4 is a cross-sectional elevational view similar to FIG. 3, but showing the clamp in an open position with the clamping windows separated from each other.

As perhaps most clearly shown in FIG. 4, the window supports 38 are supported by brackets 39 about a first pivotal axis 50 and extend partially around the first pivotal axis 50. Each of the illustrated window supports includes a first portion 38*a* that extends away from the pivotal axis 50 in a first direction and a second portion 38*b* that extends away from the same pivotal axis 50 in a second direction that is angularly oriented relative to the first direction. As noted above, the window supports 38 are generally flat, and include a flattened inner surface 38*c* that is proximal to the pivotal axis 50 (relative to the outer surface) and an outer surface 38*d* opposite the inner surface 38*c*.

Figure 3:
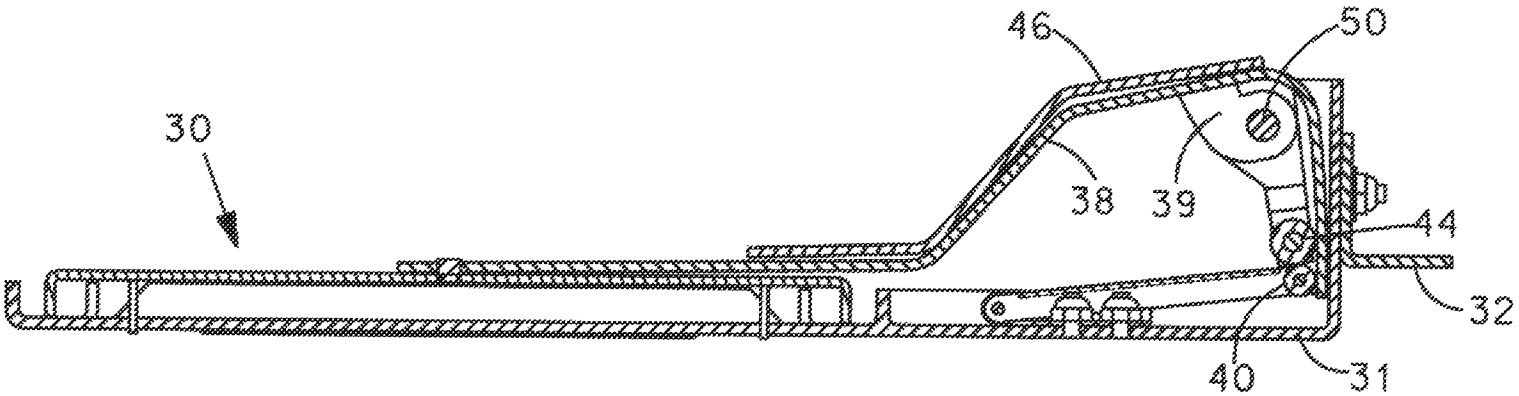
FIG. 3 is a cross-sectional elevational view of the embroidery clamp shown in FIGS. 1 and 2 taken along plane 3-3 in FIG. 2.

Movement of the upper clamping window 34 between the open position shown in FIG. 4 to the closed position shown in FIG. 3 is effectuated by a leveraged actuating system, shown most clearly in FIGS. 3-6. The specifically illustrated actuating system includes a pair of rollers 40 (only one of which is shown in FIGS. 3-6, the other roller 40 being associated with the other window support 38 in an identical manner) that roll along and selectively apply a compressive force against the bearing surface formed by inner surface 38*c*. This compressive force against the bearing surface 38*c* urges the upper clamping window 34 about the first pivotal axis 50, which in turn moves the upper clamping window 34, interconnected to the first end 38*a* of the movable window support 38, from the open position of FIG. 4 toward closed position of FIG. 3.

In the illustrated form of the invention, the rollers 40 are each supported at the ends of force transfer members, identified in the drawings with the numeral 42. The rollers 40 rotate around an axis 41 that is movable relative the frame 31 and first pivotal axis 50. The first pivotal axis 50 is stationary to the frame 31. The opposite end of the force transfer members 42 are pivotally connected to the frame 31 about a pivotal axis 43. The pivotal axis 43 is stationary relative to the frame 31 and pivotal axis 50. Each of the axes 41 and 43 are generally parallel to the first pivotal axis 50. Force is applied to the force transfer members 42 through rollers 44. These rollers rotate about pivotal axis 45, which is generally parallel to the first pivotal axis 50, but movable relative to both the pivotal axis 50 and frame 31. The rollers 44 are rotatably supported between a pair of parallel arms 47 that are rotatably supported about the first pivotal axis 50. The arms 47 are connected to, and form part of, a lever 46, which provides a manual handle applying rotational movement to the arms 47. The lever 46 is rotatably connected about the pivotal axis 50 by a bracket 39. The lever 46 also provides mechanical advantage to multiply the magnitude of force applied against it. This force is then transferred to the rollers 44, which in turn, apply a force against the force transfer member 42. Force applied against the force transfer member 42 is then applied against the bearing surface 38*d* of the window support to urge the movable clamping window 34 toward the clamping window 36.

Figure 5:
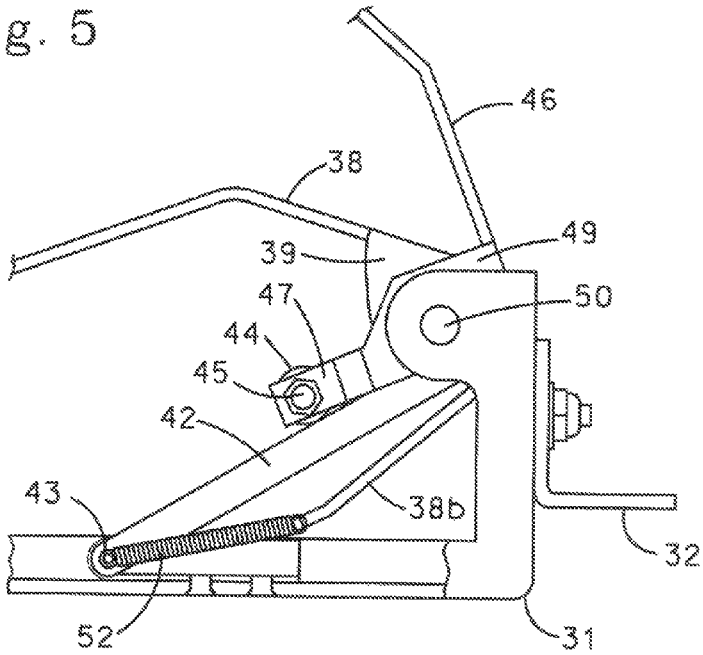
FIG. 5 is a fragmentary side elevational view of the clamp shown in FIG. 4 showing the relative positions of various components of the clamp when the clamp is in the open position illustrated in FIG. 4.
Figure 6:
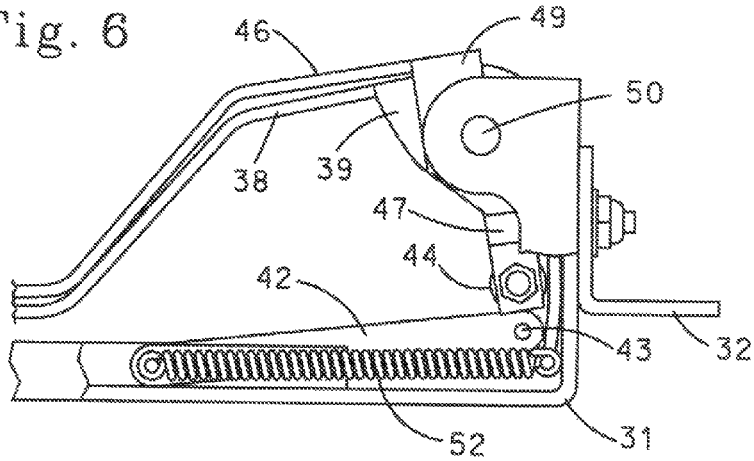
FIG. 6 is a fragmentary side elevational view of the clamp of FIG. 4 similar to FIG. 5, but showing the showing the clamp in the closed position shown in FIG. 3.

An extension spring 52 is connected between the frame 31 and the second ends of the window supports 38, as illustrated in FIGS. 5 and 6. These springs 52 resiliently urge and return the window supports 38 to the open position shown in FIG. 4, unless the force of these springs is overcome by the actuating system.

As those skilled in the art will readily appreciate from viewing FIGS. 3-6 in conjunction with FIGS. 1 and 2, FIGS. 3-6 show the actuating system from only one side of the clamp. Identical actuating system components are associated with the window support 38 on the opposite side of the clamp 30.

As noted above, the illustrated clamping windows 34 and 36 each have a quadrilateral configuration in the drawings. The side and end members of the illustrated clamping windows 34 and 36 have facing, overlapping, open channel configurations with aligned centrally disposed openings 35, 37 for accommodating a fabric to be embroidered, as illustrated in FIG. 2-4. The channels are formed by outwardly projecting walls 60. As shown in FIGS. 2 and 3, the windows 34 and 36 are dimensioned so that these channels 35, 37 overlap. Thus, when the clamping windows are in the closed position of FIG. 3, and a fabric, such as the back portion of a jacket, is interposed between the channels, the fabric is compressingly engaged between the outwardly extending walls 60 and the base of the channels to securely hold the stretched fabric during the embroidery process.

As is believed to be apparent from the above description and drawings, the above-described fabric clamp is particularly well-suited for holding and securing thick fabrics during the embroidery process. An example of a thick fabric that has proven difficult to secure in the prior art during an embroidery process is the back portion of an athletic jacket. In use, the back portion of such a fabric is placed between the upper and lower clamping when the clamp is in the open position shown in FIG. 4. When the fabric is properly located relative to the clamping windows, manual pressure is applied to the levers 46 to initiate the closing process. When the levers 46 are depressed, the lever is rotated about the first pivotal axis 50. This action forces the arms 47 and rollers 44 to rotate about the pivotal axis 50 and apply pressure against the force transfer members 42. As the force is continued, rollers 44 roll along the surface of force transfer member 42 toward the rollers 40. This, in turn, forces rollers 40 to move (downward in the orientation of FIG. 4) along the bearing surface formed by inner surface **38*b* of window support 38. This rolling movement of roller 40 along surface 38*b* causes the window support 38 to rotate (counterclockwise in FIG. 4) about the pivotal axis 50, thus causing the clamping window 34 to move toward clamping window 36, from the position shown in FIG. 4 to the position shown in FIG. 3**.

When a thick fabric, such as the back of an athletic jacket is interposed between the clamping windows 34 and 36, the clamping windows 34 and 36 cannot completely close as shown in FIG. 3. The clamp described above nevertheless holds the fabric securely. As noted above, the window supports 38 may be formed of resilient material, and the window supports 38 also may be configured so as to promote flexing and to allow the window supports 38 to function as springs. Moreover, the levered actuating system greatly multiplies the force applied against the handle portions of the levers 46, and can be used to apply a substantial closing force with the application of only minimal pressure against the levers 46. Thus, when this substantial closing force is applied against the window supports 38, and a thick fabric interposed between the clamping windows 34 and 36 prevent full closure, the resilient properties of the window supports 38 allow flexure of the window supports. This permits the actuating system to move to the position shown in FIG. 3 despite the fact that there is some separation between the clamping windows 34 and 36. Thus, a substantial closing force can be applied to a wide range of fabric thicknesses when those fabrics are interposed between the clamping windows 34, 36.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such embodiments and variations are within the scope of the invention as determined by the appended claims when interpreted in accordance with the breadth to which they are fairly, legally, and equitably entitled. The drawings and preferred embodiments do not and are not intended to limited the ordinary meaning of the claims in their fair and broad interpretation in any way.

What is claimed is:

1. A fabric clamp for an embroidery machine, comprising:

(a) a frame;

(b) at least one movable window support, the window support being pivotally connected to the frame about a first pivotal axis and having a configuration partially extending around the first pivotal axis, a first portion of the window support extending away from the first pivotal axis in a first direction and a second portion extending away from the first pivotal axis in a second direction that is angularly oriented relative to the first direction, the movable window support having an inner surface located proximally to the pivotal axis relative to an outer surface opposite the inner surface;

(c) a first clamping window fixedly secured relative to the frame;

(d) a second clamping window interconnected to, and movable with, the first end portion of the window support; and (e) an actuating system for applying a force against the second portion of the movable window support, the actuating system including:

i. a lever pivotally connected to the frame about the first rotational axis, the lever including a first lever arm extending away from the first rotational axis in a first direction from a first position about the first rotational axis and a second lever arm extending outwardly from the first rotational axis from a second position circumferentially spaced to the first position;

ii. a roller connected to the second lever arm, the roller being rotatable about and a second rotational axis that is parallel to the first rotational axis and rotates relative the first rotational axis;

iii. an elongated force transfer member, the force transfer member being pivotally connected to the frame at one end and supporting a roller at its opposite end, the roller supported by the force transfer member being rotatable about a third rotational axis extending parallel to the first and second rotational axes; the roller supported by the lever arm being in rolling engagement with the force transfer member intermediate the end that is pivotally connected to the frame and the end supporting the roller, and the roller supported by the force transfer member being in rolling engagement with the with the inner surface of the second portion of the movable window support, the actuating system being configured so that rotational movement of the first lever arm rotates the roller at the end of the second lever arm against the force transfer member and causes rolling movement of the roller supported at the end of the force member along the inner surface of the second portion of the window support.

2. A fabric clamp as recited in claim 1 wherein the first lever arm provides a mechanical advantage to the force applied to the second portion of the window support.

3. A fabric clamp as recited in claim 1 further including a spring for resiliently urging the second portion of the movable window support to a first open position.

4. A fabric clamp as recited in 3 where the spring includes a plurality of extension springs.

5. A fabric clamp as recited in claim 1 wherein the second clamping window has a channel configuration with a base separating a pair of sidewalls projecting outwardly from the base in spaced parallel relationship in a direction toward the first clamping window.

6. A fabric clamp as recited in claim 5 wherein the first clamping window has a channel configuration with a base and a pair of sidewalls projecting outwardly from the base in spaced parallel relationship in a direction toward the second clamping window, and wherein first clamping window is sized relative to the second clamping window so that the channels overlap and one of the sidewalls is interposed between the sidewalls of the other clamping window when the first and second clamping windows are move together.

7. A fabric clamp as recited in claim 6 wherein the first and second clamping windows each include a centrally disposed opening for accommodating a fabric to be embroidered.

8. A fabric clamp as recited in claim 7 wherein each of the first and second clamping windows has a quadrilateral configuration with four right angles.

9. A fabric clamp as recited in claim 1 wherein the movable clamping window is supported by a plurality of movable window supports.

10. A fabric clamp as recited in claim 9 wherein each of the movable window supports has an elongated configuration with a dimension in the direction of movement that is thin relative to its other dimensions.

11. A fabric clamp as recited in claim 9 wherein the movable window supports are resiliently flexible in the direction of movement.

12. A fabric clamp as recited in claim 1 wherein the first lever arm is configured as a manual lever.

13. A fabric clamp for an embroidery machine, comprising:

(a) a frame;

(b) at least two movable window supports, the window supports each being pivotally connected to the frame about a first pivotal axis and having a configuration partially extending around the first pivotal axis, a first portion of each of the window supports extending away from the first pivotal axis in a first direction and a second portion of each of the window supports extending away from the first pivotal axis in a second direction that is angularly oriented relative to the first direction, each of the movable window supports having inner surfaces located proximally to the pivotal axis relative to outer surfaces opposite the inner surfaces;

(c) a first clamping window fixedly secured relative to the frame;

(d) a second clamping window interconnected to, and movable with, the first end portion of the window supports, the second clamping window a pair of spaced clamping window components; and (e) an actuating system for simultaneously applying a force against the second portion of each of the movable window supports, the actuating system including:

i. a lever pivotally associated with each of the window supports, each of the levers being connected to the frame about the first rotational axis, each of the levers including a first lever arm extending away from the first rotational axis in a first direction from a first position about the first rotational axis and a second lever arm extending outwardly from the first rotational axis from a second position circumferentially spaced to the first position;

ii. a roller connected to each of the second lever arms, the rollers being rotatable about and a second rotational axis that is parallel to the first rotational axis and rotates relative the first rotational axis; and iii. an elongated force transfer member associated with each lever, the force transfer members being pivotally connected to the frame at one end and supporting a roller at their opposite ends, the rollers supported by the force transfer members being rotatable about a third rotational axis extending parallel to the first and second rotational axes; the rollers supported by the lever arms being in rolling engagement with one of the force transfer member intermediate the ends that are pivotally connected to the frame and the end supporting the roller, and the rollers supported by the force transfer members being in rolling engagement with the with the inner surfaces of the second portion of the movable window support, the actuating system being configured so that rotational movement of the first lever arms rotates the roller at the end of the second lever arms against the force transfer members and causes rolling movement of the rollers supported at the end of the force member along the inner surface of the second portion of the window support.

* * * * *